US007736134B2

(12) United States Patent
Schneider

(10) Patent No.: US 7,736,134 B2
(45) Date of Patent: Jun. 15, 2010

(54) VANE MACHINE, IN PARTICULAR VANE PUMP

(75) Inventor: Willi Schneider, Bodelshausen (DE)

(73) Assignee: Joma-Polytec Kunststofftechnik GmbH, Bodelshausen (DE)

( * ) Notice: Subject to any disclaimer, the term of this patent is extended or adjusted under 35 U.S.C. 154(b) by 145 days.

(21) Appl. No.: 11/920,764

(22) PCT Filed: Oct. 10, 2006

(86) PCT No.: PCT/EP2006/009765

§ 371 (c)(1),
(2), (4) Date: Nov. 21, 2007

(87) PCT Pub. No.: WO2007/101457

PCT Pub. Date: Sep. 13, 2007

(65) Prior Publication Data

US 2009/0169409 A1 Jul. 2, 2009

(51) Int. Cl.
*F04C 2/344* (2006.01)

(52) U.S. Cl. ..... 418/26; 418/29; 418/30; 418/31; 418/241; 418/259; 417/220

(58) Field of Classification Search ..... 418/259, 418/266, 260, 241, 268, 26, 29, 30, 31; 417/220
See application file for complete search history.

(56) References Cited

U.S. PATENT DOCUMENTS

| | | | | |
|---|---|---|---|---|
| 2,064,635 | A * | 12/1936 | Stern | 418/173 |
| 2,250,947 | A | 9/1941 | Carpenter | |
| 2,778,317 | A * | 1/1957 | Cockburn | 418/241 |
| 3,421,413 | A * | 1/1969 | Adams et al. | 418/268 |
| 7,540,729 | B2 * | 6/2009 | Schneider | 418/260 |
| 2006/0191360 | A1 * | 8/2006 | Beez | 74/25 |
| 2007/0292291 | A1 * | 12/2007 | Schneider et al. | 418/24 |
| 2008/0014108 | A1 * | 1/2008 | Schneider | 418/266 |

FOREIGN PATENT DOCUMENTS

| | | |
|---|---|---|
| BE | 393 530 | 2/1933 |
| DE | 195 04 220 | 8/1996 |
| IT | 319 467 | 9/1929 |

* cited by examiner

*Primary Examiner*—Thomas E Denion
*Assistant Examiner*—Mary A Davis
(74) *Attorney, Agent, or Firm*—Paul Vincent

(57) ABSTRACT

A vane machine comprises an inner rotor (28) and an outer rotor (51). A plurality of radially extending vane elements (32) separates first vane chambers (89) from one another. The van elements (32), with a radially inner end region (34), are accommodated in the inner rotor (28) in a radially displaceable manner and, with a radially outer end region (36), are accommodated in the outer rotor (51) in a pivotable manner. It is proposed that the radially inner end regions (34) of the vane elements (32) be accommodated in the inner rotor (28) at a fixed angle and that the outer rotor (51) comprise individual shoes (38) which are separate for each vane element (32) and in which the vane elements (32) are accommodated in a pivotable manner.

11 Claims, 9 Drawing Sheets

VANE MACHINE, IN PARTICULAR VANE PUMP

This application is the national stage of PCT/EP2006/009765 filed on Oct. 10, 2006.

BACKGROUND OF THE INVENTION

The invention relates to a vane machine, in particular a vane pump.

A vane pump with a ring-shaped inner rotor is known from DE 100 40 711 A1 and holds a number of vane elements extending radially to the outside, which are radially movable. The radially internal end areas of the vane elements rest upon a rotationally secure central part and the radially external end areas upon a rotationally secure outer ring. The rotor can be turned around a rotary axis which is displaced with respect to the center axis of the central part and the outer ring. Delivery cells, initially becoming larger and then smaller, are thereby formed between the vane elements when the rotor rotates. Due to the volume change of the delivery cells, fluid is initially suctioned into the delivery cells and then discharged. The end areas of the vane elements slide on the central part or on the outer ring. Such a vane pump can be manufactured easily and at low cost.

For increasing the efficiency, a vane machine in the form of a pendulum slide pump is known from DE 195 32 703 C1. The vane elements are thereby slidably held in an inner rotor and are held rotatably in a ring-shaped outer rotor. The rotary axis of the inner rotor is displaced with respect to the rotary axis of the outer rotor as a result of which delivery cells initially becoming larger and then smaller again, also form during operation. However, the pendulum slide pump known from DE 195 32 703 C1 is complex and its production is therefore expensive.

The task of this invention is to create a vane machine which has a high degree of efficiency and can at the same time be produced simply and at little cost.

SUMMARY OF THE INVENTION

This task is solved with a vane machine having the characteristics of the independent claim.

By basically holding the radially internal end areas of the vane elements in the inner rotor at fixed angles, very good sealing between the vane elements and the inner rotor is achieved, which improves the efficiency of the vane machine. Moreover, due to the omission of the pivoting option required for a pendulum slide machine, the manufacture of the vane machine according to the invention is simplified in this area which, in turn, lowers the production costs.

Due to the fact that the outer rotor comprises individual shoes for each vane element with which the vane elements are rotatably connected, good sealing between the outer rotor and the vane elements is also achieved in this area, further improving the degree of efficiency of the vane machine according to the invention. Moreover, an additional variable volume results between adjacent shoes during operation of the vane machine design according to the invention which also leads to improved efficiency.

In accordance with an advantageous design of the vane machine, the radially outer area of a vane element is fixed rotatably at its shoe and the shoe is positively driven in the circumferential direction. This avoids the need for a radially internal central element which again simplifies the design of the vane machine according to the invention.

The vane pump design is also simplified when it comprises a rotationally secure housing section arranged radially outside the shoes, against which the shoes glidingly rest during operation. Such a gliding cooperation between the shoes and the rotationally secure housing section allows for good sealing and can nevertheless be implemented at low cost.

A precise compulsory guiding with a simultaneous low frictional resistance, simple production and most of all simple installation can be realized when at least one edge area of a shoe is guided slidingly in a guideway. This can be, for example, a lateral notch or formed between an outer ring and a ring-shaped step of a lateral cover element.

Since the shoes provide a comparatively large sealing surface, sufficient sealing and thus good efficiency of the vane machine according to the invention is achieved even if a sliding bearing of the shoes—as mentioned above, for example—works dryly, i.e. without the use of additional lubricants or sealing compounds. This is especially advantageous when using the vane machine according to the invention as a vacuum pump or compressor, since this prevents contamination of the gas flow by such substances.

In order to minimize the dead volume within a delivery cell and thus optimize the efficiency of the vane machine according to the invention, it is suggested that the shoes extend so far in circumferential direction that the gap between adjacent shoes is nearly zero in every area of the vane machine in which the volume of the first delivery cells is minimal.

It is also advantageous when the vane machine comprises at least one second delivery cell which is formed between the radially internal end area of a vane element and the inner rotor. This delivery cell is of the type used for common piston pumps. This further improves the efficiency, since a larger overall delivery volume is available.

Adding to simplification of the vane machine design, the first and second delivering delivery cells and/or the first and second suctioning delivery cells can each be connected to each other via at least one channel. Moreover, this channel is advantageously available as a notch in a lateral cover element and runs at an angle with respect to a radius line which is larger than 0°, in particular larger than 45°. This prevents any interactions between a vane element and the channel.

BRIEF DESCRIPTION OF THE DRAWING

A preferential design example of this invention is explained in detail below with reference to the attached drawings. The drawings show the following.

DESCRIPTION OF THE PREFERRED EMBODIMENT

Figure 1:
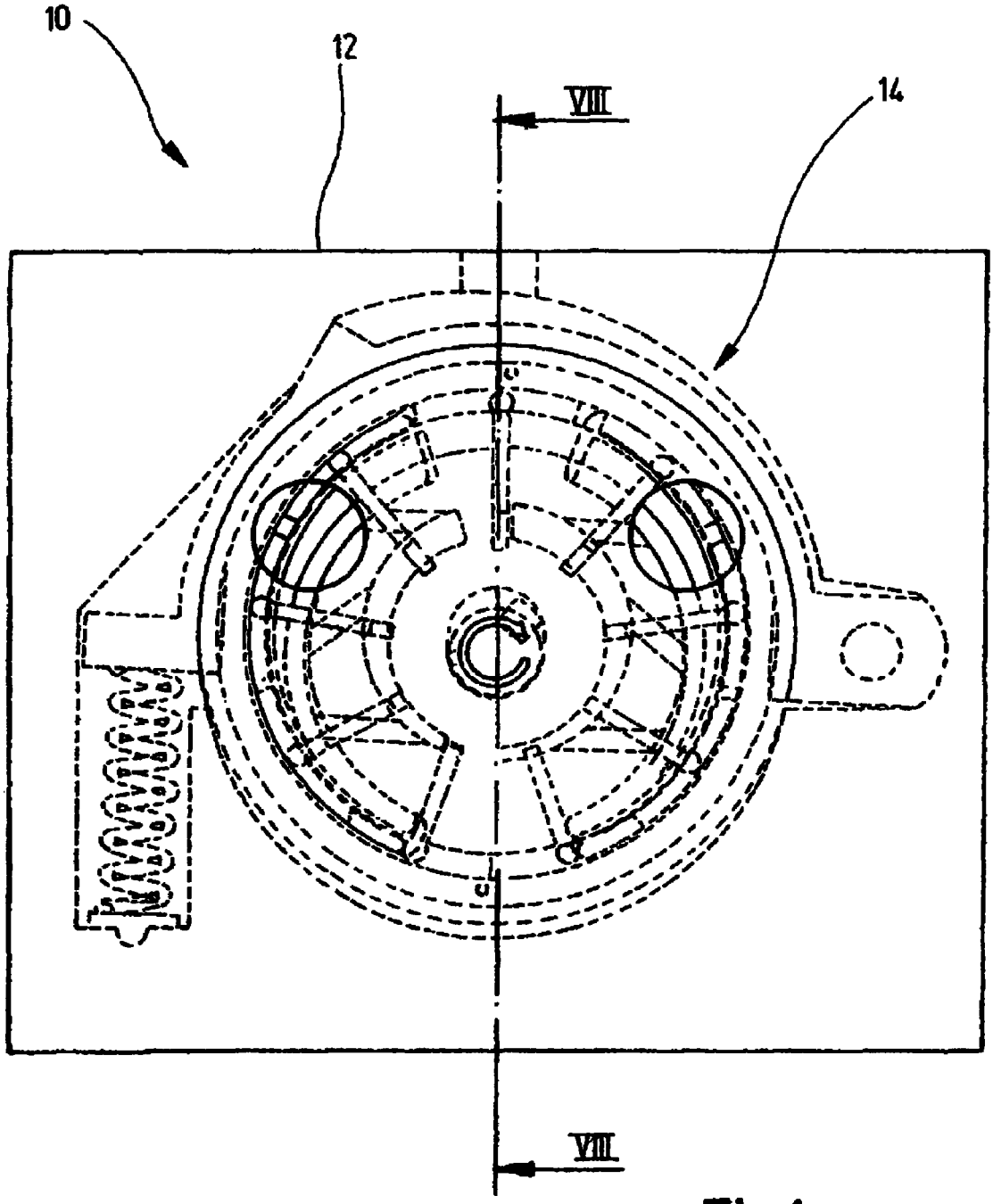
FIG. 1 shows a plan view on a vane pump.

In FIGS. 1 to 9, a vane pump has the reference numeral 10. Note that, for reasons of clarity, not all reference numerals are entered in all subsequent figures. As shown especially in FIG. 2, the pump comprises a cylindrical housing 12 which consists of a pot-like part 12*a* and a frontal cover 12*b*. A pump module 14 is arranged in the housing 12.

Figure 2:
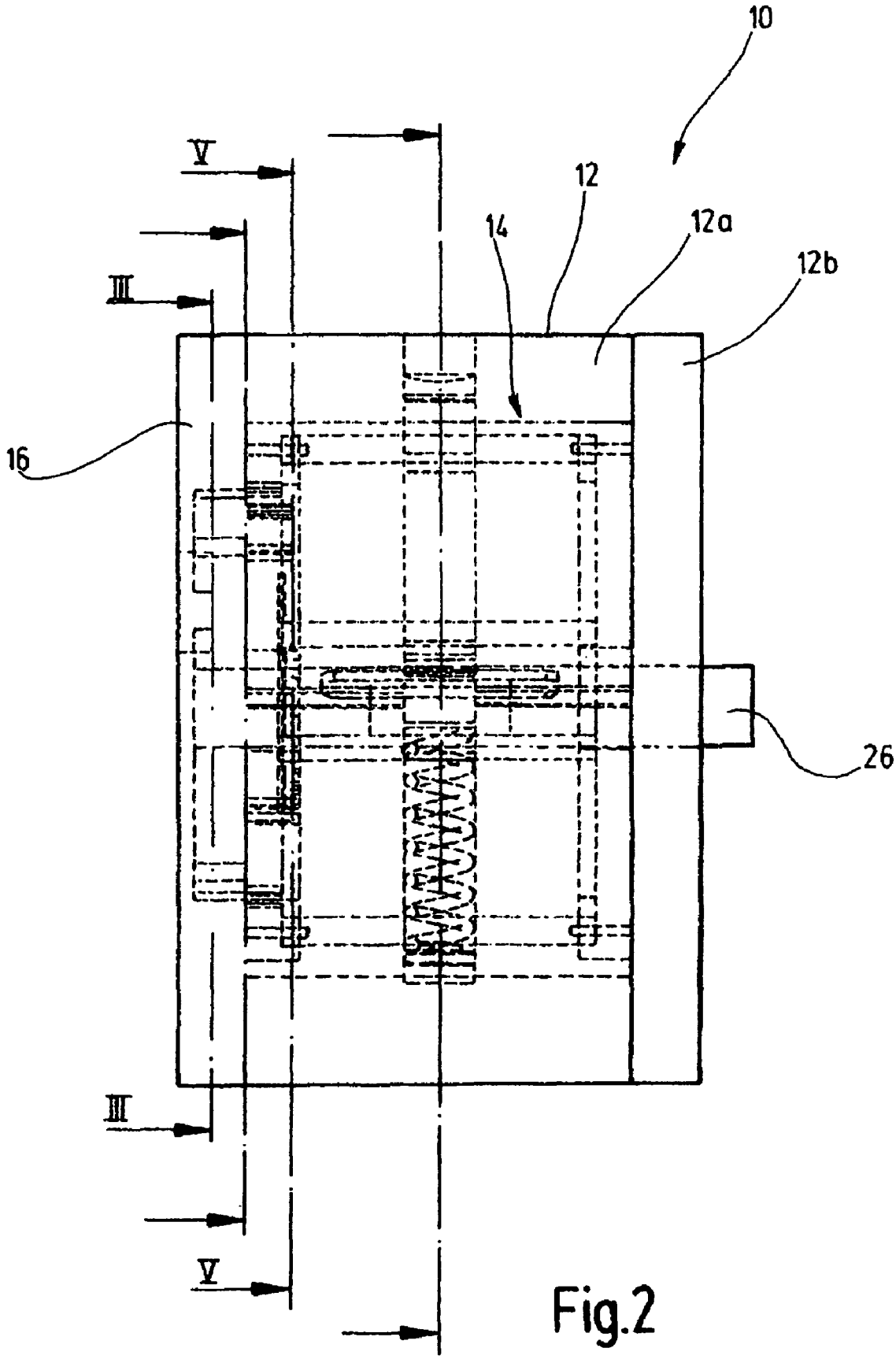
FIG. 2 shows a side view of the vane pump of FIG. 1.
Figure 3:
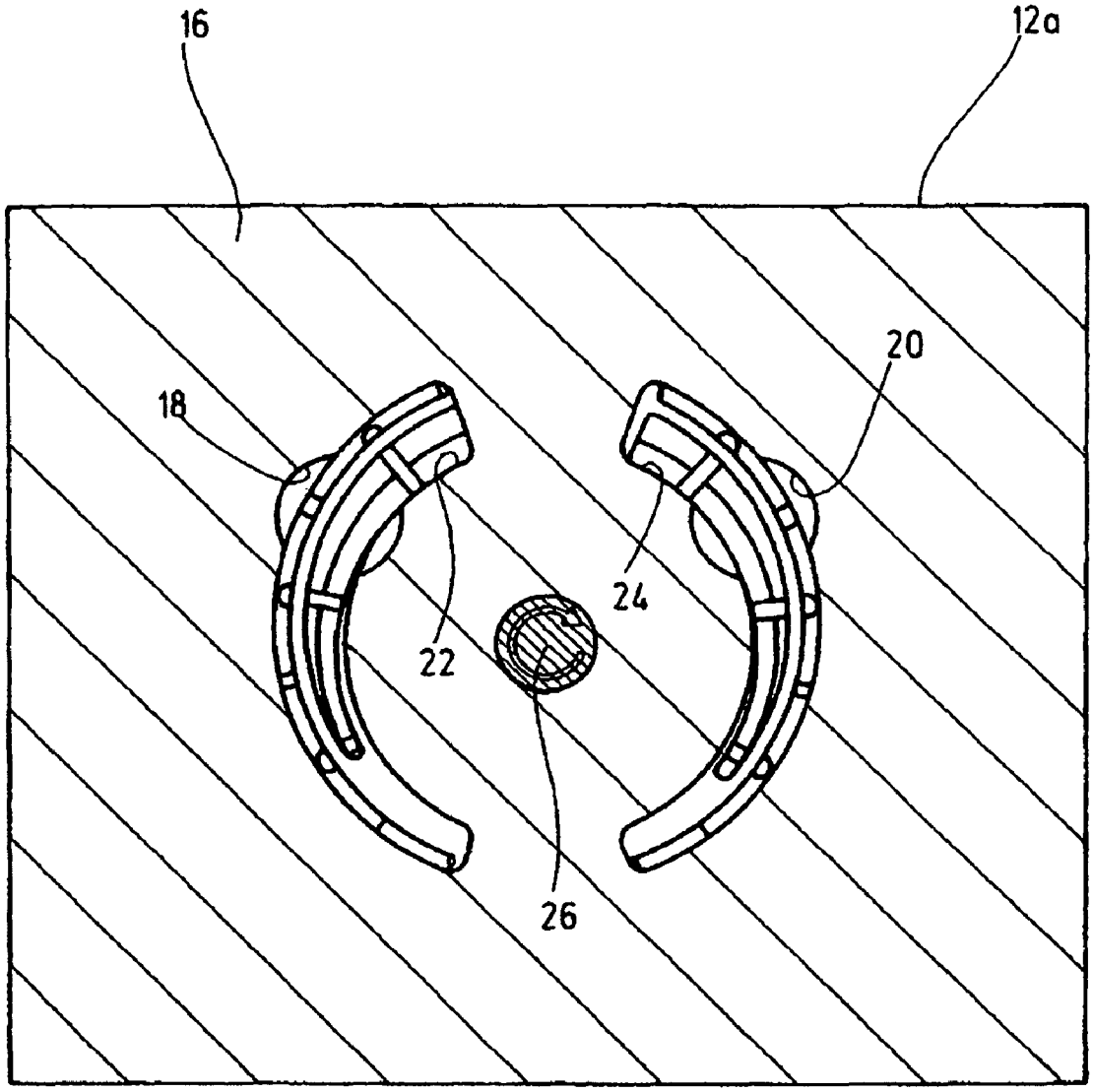
FIG. 3 shows a cut along the line III-III of FIG. 2.

FIG. 3 shows a cut III-III of FIG. 2 through an area of a base 16 of the pot-like section 12*a* of the housing 12. The base 16 has an inlet 18 and an outlet 20, communicating with the kidney-shaped opening 22 or 24 on the interior of the base 16. A drive shaft 26 is also mounted to the base 16 and penetrates the cover 12*b* of the housing 12 at its opposite end for connection to a corresponding drive equipment via a coupling (not shown).

Figure 6:
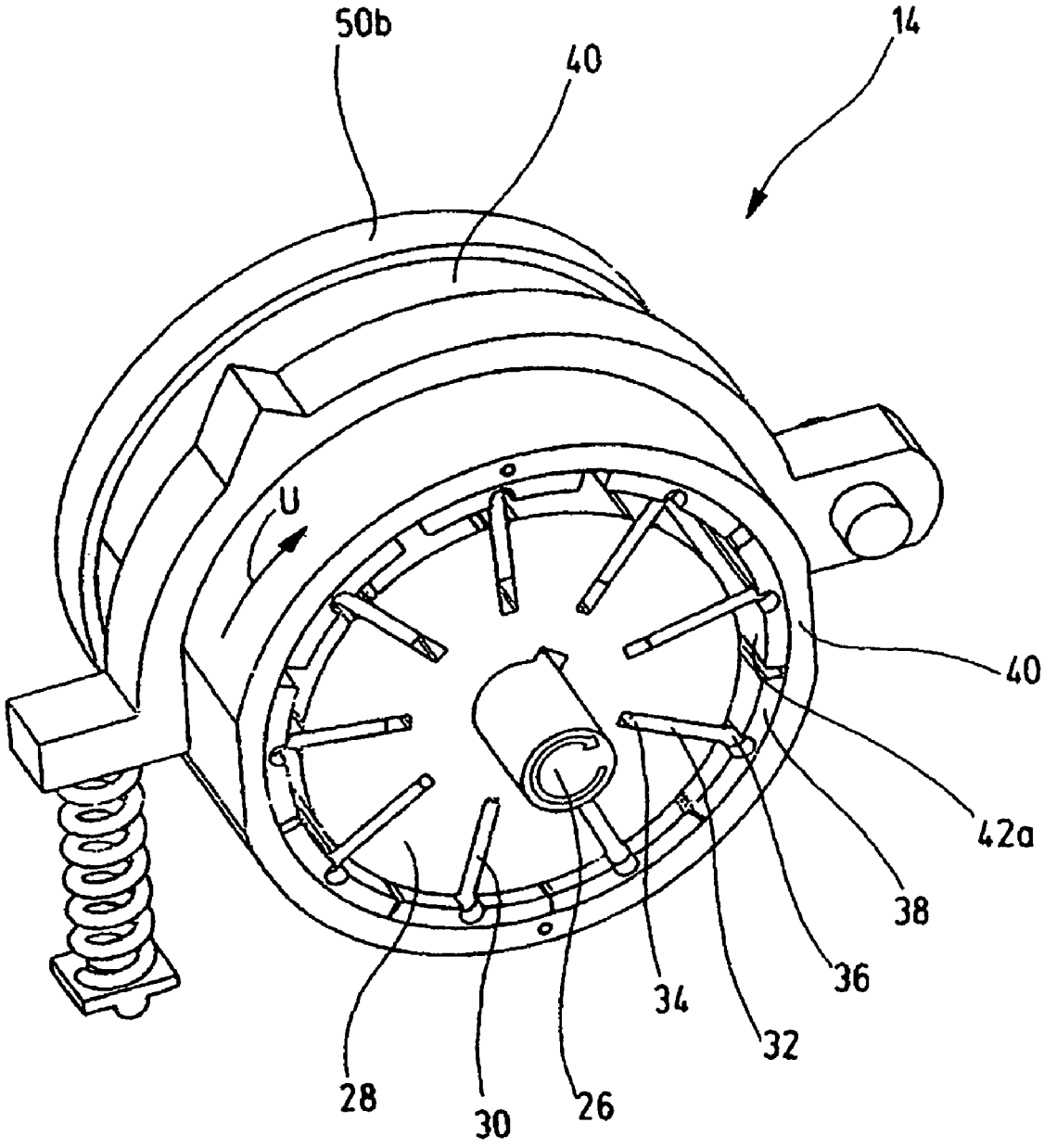
FIG. 6 shows a perspective view similar to FIG. 3 into the interior of the pump module.
Figure 7:
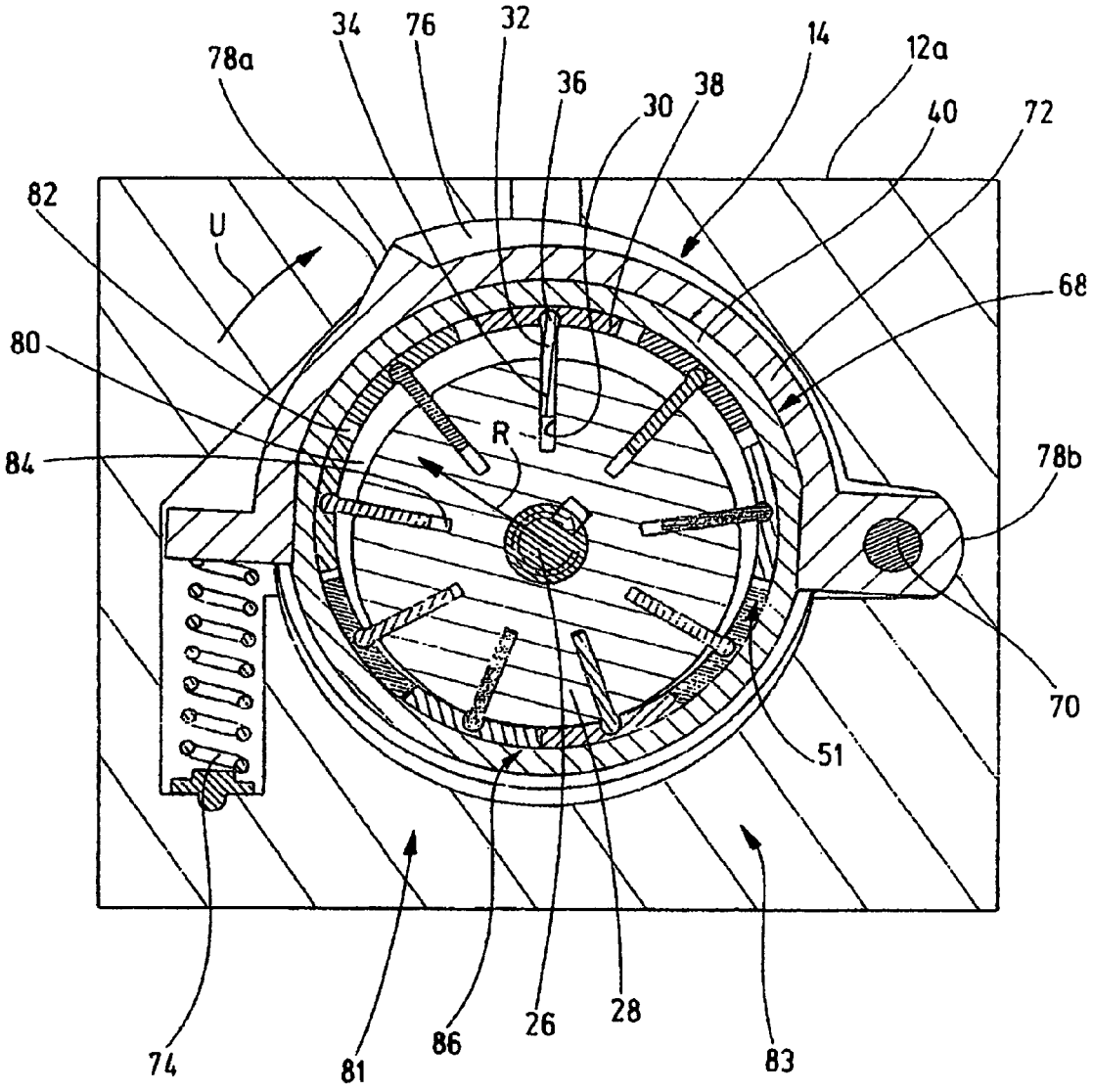
FIG. 7 shows a cut along the line VII-VII of FIG. 2.

FIGS. 6 and 7, for example, also show that the drive shaft 26 is connected with a cylindrical inner rotor 28 which has several slots 30 extending radially, distributed about the circumference, which are, however, not all provided with a reference numeral for reasons of clarity. Each slot 30 holds a portion of a rectangular, plate-like vane element 32, which can slide therein in a radial direction but at fixed angles relative to the inner rotor 28. The radially internal end area 34 of a vane element 32, which is held in the corresponding slot 30 of the vane element 32, is straight whereas the radially external end area of a vane element 32 has an axle-like swelling 36 with a circular outer cross-sectional contour. The longitudinal axis of this swelling 36 runs parallel to the longitudinal axis of the drive shaft 26.

The circularly thickened end area 36 of a vane element 32 is held in a shoe 38 in a complementary recess (without reference numeral). The vane element 32 and shoe 38 are thereby fixedly connected with each other in the radial direction (arrow R in FIG. 7) and in the circumferential direction (arrow U in FIG. 7), but the vane element 38 can pivot relative to the shoe 38 within a certain angular range due to the positive connection. In this respect, the end swelling 36 on the vane element 32 forms a swivel axis.

The shoes 38 as well as the vane elements 32 are designed identically to each other, as ring-segment-like shell parts with a common center axis. They rest against a radially internal limiting wall of an outer ring 40 which is connected to the housing 12 in a rotationally secure fashion as described further below.

Figure 8:
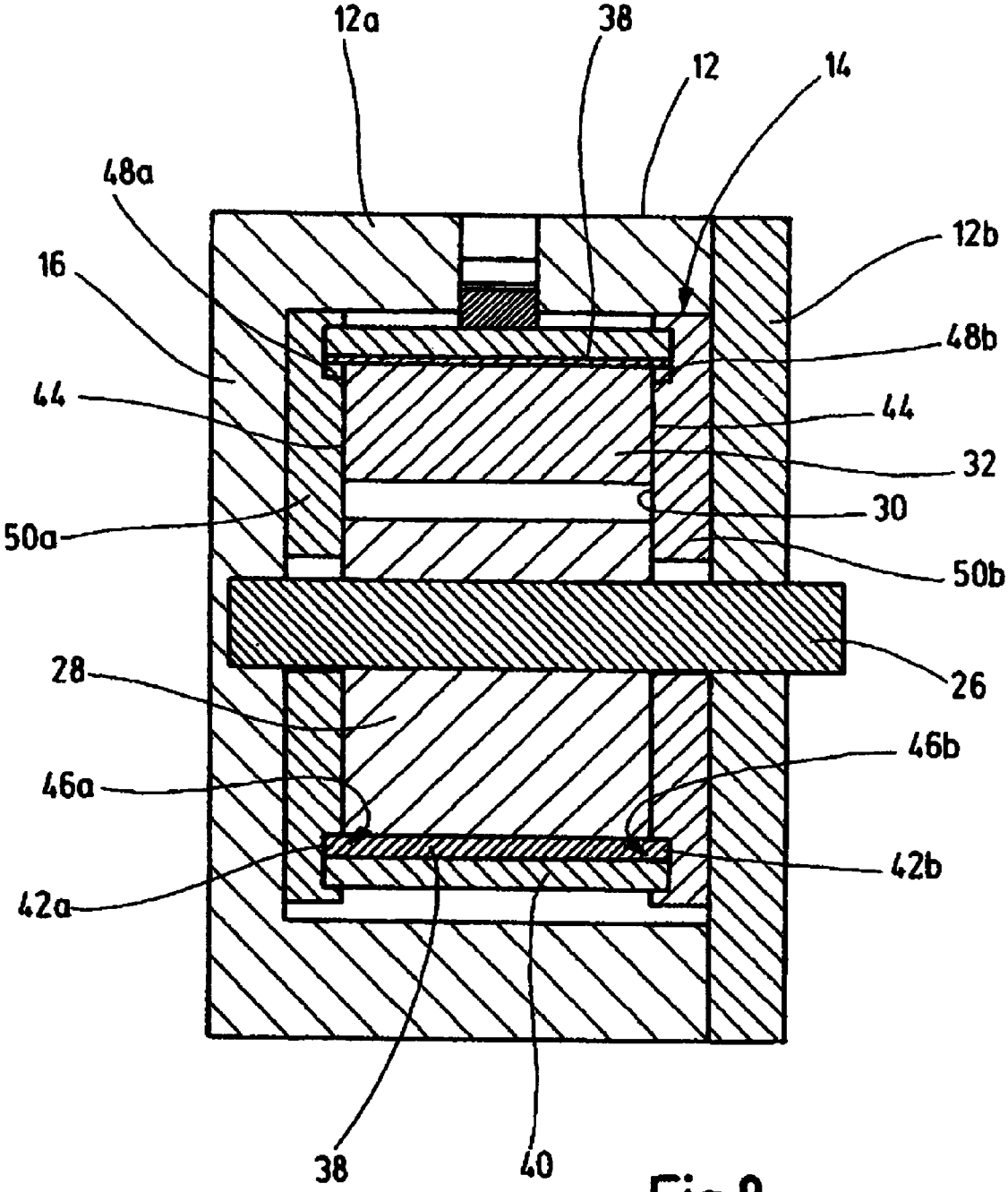
FIG. 8 shows a cut along the line VIII-VIII of FIG. 1.

As shown especially in FIG. 8, the shoes 38—seen in the direction of the drive shaft 26—are longer than the vane elements 32. They therefore, overlap the lateral rims 44 of the vane elements 32 with lateral edge areas 42*a* and 42*b*. This overlapping of the lateral edge areas 42*a* and 42*b* provides compulsory guiding of the shoes 38 in a guideway 46*a*/46*b*. The latter is formed by the outer ring 40 which, seen in the direction of the drive shaft 26, is as long as the shoes 38, and a ring-shaped step 48*a*/48*b* provided by the lateral cover elements 50*a* and 50*b*, fixedly connected to the outer ring 40. The two cover elements 50*a* and 50*b* thus form the frontal limitations of the pump module 14 (see also FIG. 4). The shoes 38 form an outer rotor 51.

The left (FIG. 8) and front (FIG. 4) cover element 50*a* has a suction kidney 52 and a pressure kidney 54 and a suction opening 56 located radially outside on a level with the shoes 38 as well as a corresponding pressure opening 58. As shown in FIG. 5, additional notch-like and kidney-shaped openings 60 and 62 which are arranged on the inside of the cover element 50*a* facing the vane elements 32, radially inward from the suction kidney 52/pressure kidney 54 and approximately on a level with the radially internal area of the slots 30. Note that the kidney-shaped opening 60 arranged in the area of the suction kidney 52 extends over a smaller area in the circumferential direction U than the kidney-shaped opening 62 arranged in the area of the pressure kidney 54.

The internal kidney-shaped opening 60, the suction kidney 52 and the suction opening 56 are connected fluidically with each other via notch-like channels 64 also disposed on the interior of the cover element 50*a* facing the vane elements 32. Analogously, the kidney-shaped recess 62, the pressure kidney 54 and the pressure opening 58 are connected with each other via corresponding notch-like channels 66. The channels 64 and 66 run at an angle of approximately 45° with respect to the radius line R.

Figure 4:
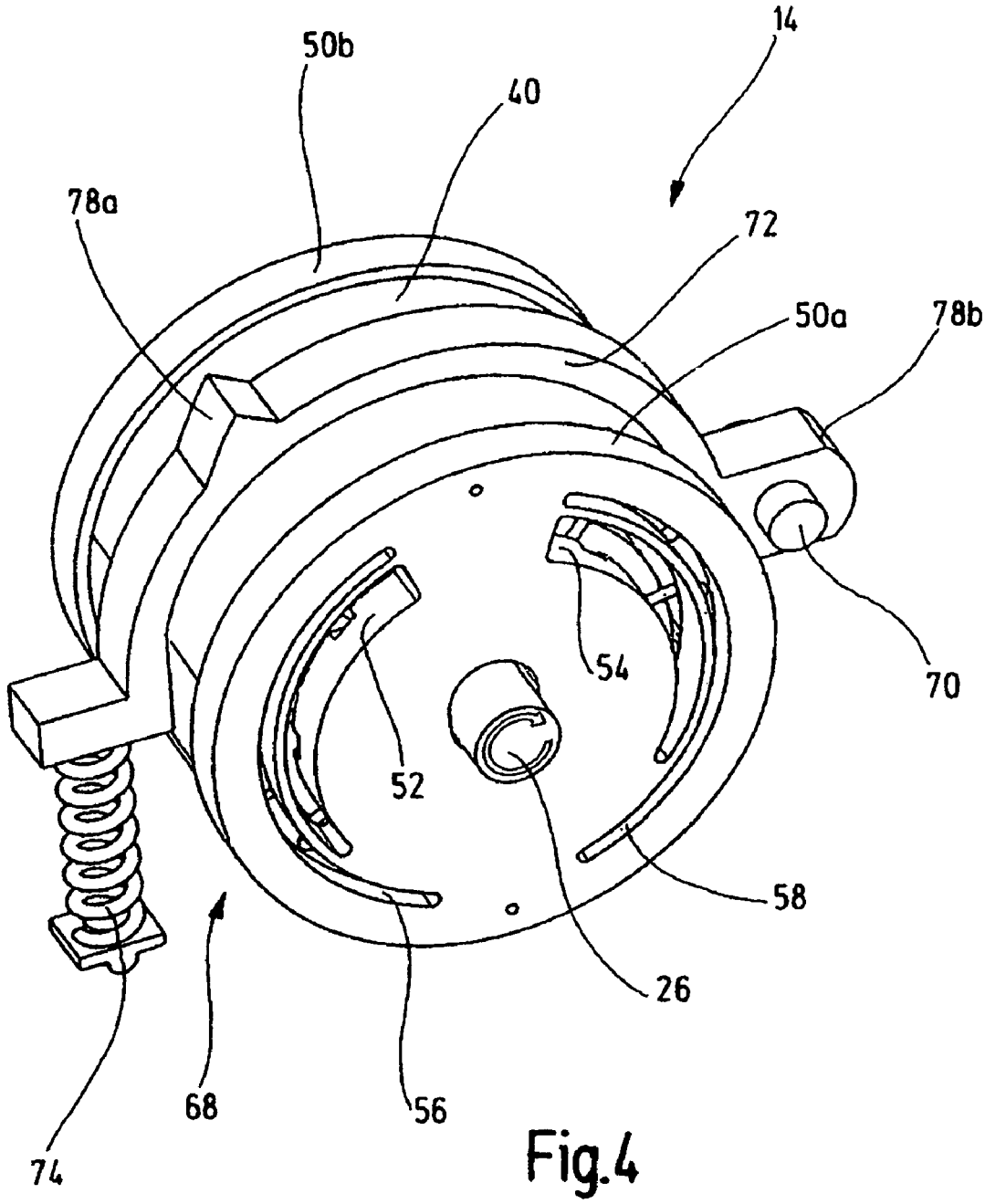
FIG. 4 shows a perspective representation of a pump module of the vane pump of FIG. 1.
Figure 5:
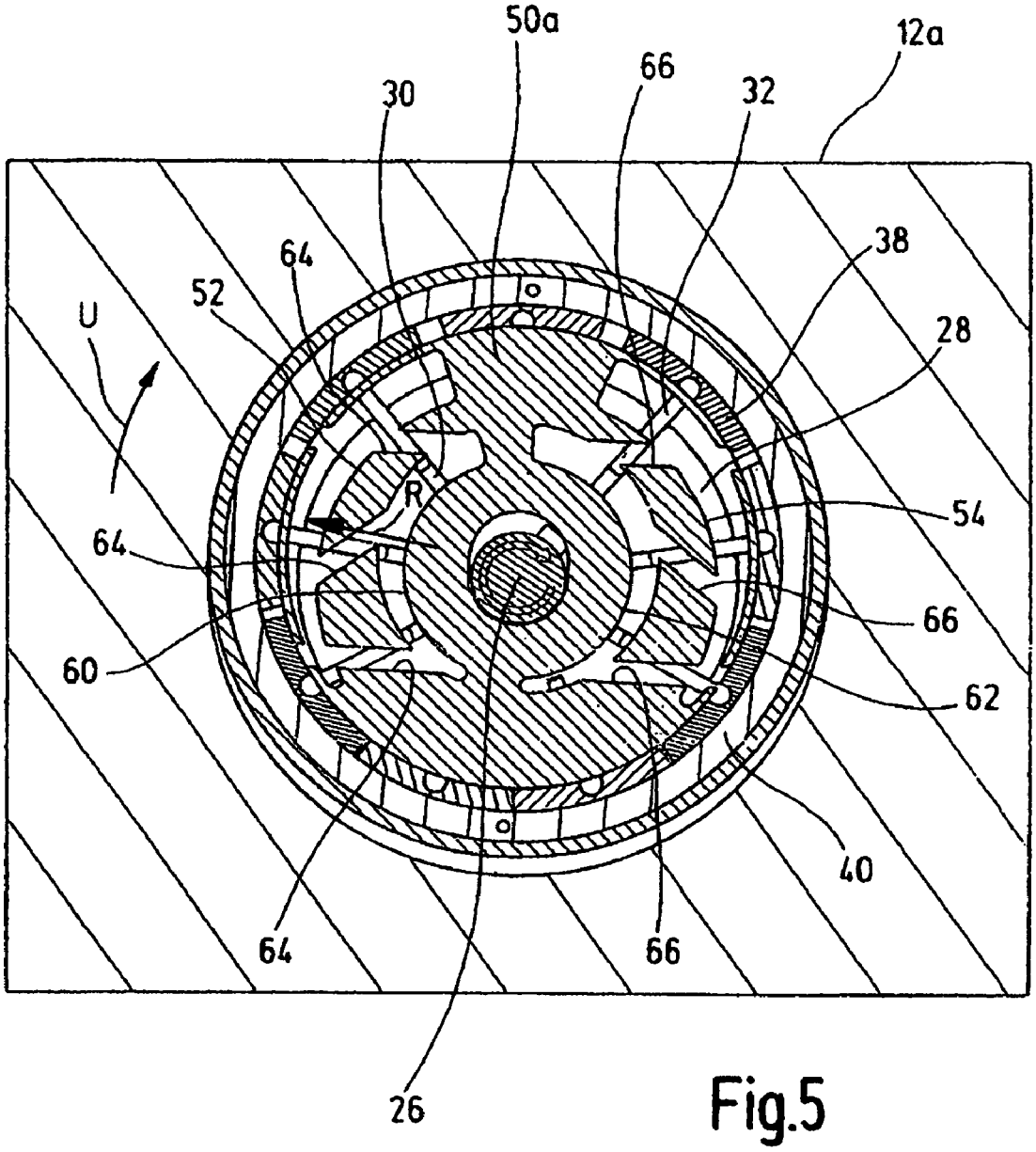
FIG. 5 shows a cut along the line V-V of FIG. 2.

As shown especially in FIGS. 4 and 7, the unit formed by the outer ring 40 and the lateral cover elements 50*a* and 50*b*—referenced with 68—to which the shoes 38 and the vane elements 32 also belong due to the compulsory guiding in the guideway 46, can be pivoted around an axis 70. Towards this end, the outer ring 40 is connected with a bracket element 72 which is urged into the position shown in FIG. 7 via a spring 74. The center axis of the unit 68 is thereby not on the center axis of the drive shaft 26 but offset, parallel thereto. Due to the loading of a pressure region 76 with a fluid pressure, the bracket element 72 and thereby the unit 68 can be pivoted about the axis 70 in opposition to the tension of the spring 74 until the center axis of the unit 68 and the longitudinal axis of the drive shaft 26 are concentric. The bracket element 72 defines the sealing surfaces 78*a* and 78*b* which interact slidingly with the housing 12 for sealing the pressure region 76.

The vane pump 10 works as follows, first of all regarding the position of the unit 68 shown in FIG. 7. When the drive shaft 26 rotates in the direction of the arrow 79, the inner rotor 28 is also set into rotation. The vane elements 32 are thereby also carried along and with these also the shoes 38 which form the outer rotor 51. Since, in the position of the unit 68 shown in FIG. 7, its center axis is offset compared to the rotary axis of the drive shaft 26, first delivery cells 80 are formed between the outer ring 40, shoes 38, vane elements 32 and inner rotor 28, the volume of which first increases on a suction side 81 and then decreases again on a pressure side 83.

Due to the guiding of the vane elements 32 in the slots 30 and the positive holding of the swivel axis 36 of a vane element 32 in the recess in the shoe 38 complementary thereto, adjacent delivery cells 80 are well sealed with respect to each other. Due to the increasing volumes of the first delivery cells 80 on the suction side 81, fluid is suctioned into the delivery cells 80 via the corresponding suction kidney 52, the kidney-shaped opening 22 and the inlet 18. As shown very clearly in FIGS. 6 and 7, the distances between adjacent shoes 38—seen in the circumferential direction U—are also variable insofar as they also increase on the suction side 81 during rotation. An additional delivery volume 82 within the first delivery cells 80 is thereby achieved.

As shown in the same figures, a slot 30 between the radially internal end area 34 and the inner rotor 28 forms a second delivery cell 84 the volume of which also increases on the suction side 81 and decreases on the pressure side 83. These delivery cells 84 are also filled with fluid on the suction side via the radially internal kidney-shaped opening 60, the channels 64, the suction kidney 52 and the kidney-shaped opening 22. As the volume of the first delivery cells 80 and the second delivery cells 84 thereby decreases on the pressure side 83, the fluid located therein is pressed via the pressure kidney 54 or the kidney-shaped opening 62 and the channels 66 to the kidney-shaped opening 24 and from there to the outlet 20. The fluid volume 82 located between adjacent shoes 38 can also escape through the pressure opening 58 to the outlet 20. As also shown very clearly in FIGS. 6 and 7, the extent of the shoes 38 in the circumferential direction U is selected in such a way that, in each area (reference numeral 86) of the vane pump 10 in which the volume of the first delivery cells 80 is minimal, the gap between adjacent shoes 38 is almost zero.

As already stated above, the shoes 38 with their radial outside interact slidingly with the inner wall of the outer ring 40. Due to the comparatively large sealing surface, a good sealing between adjacent first delivery cells 80 is maintained without the need of additional sealants, in particular, without lubricants. A reduction of the sliding friction between the shoes 38 and the outer ring 40 can be achieved with a corresponding choice of material.

Figure 9:
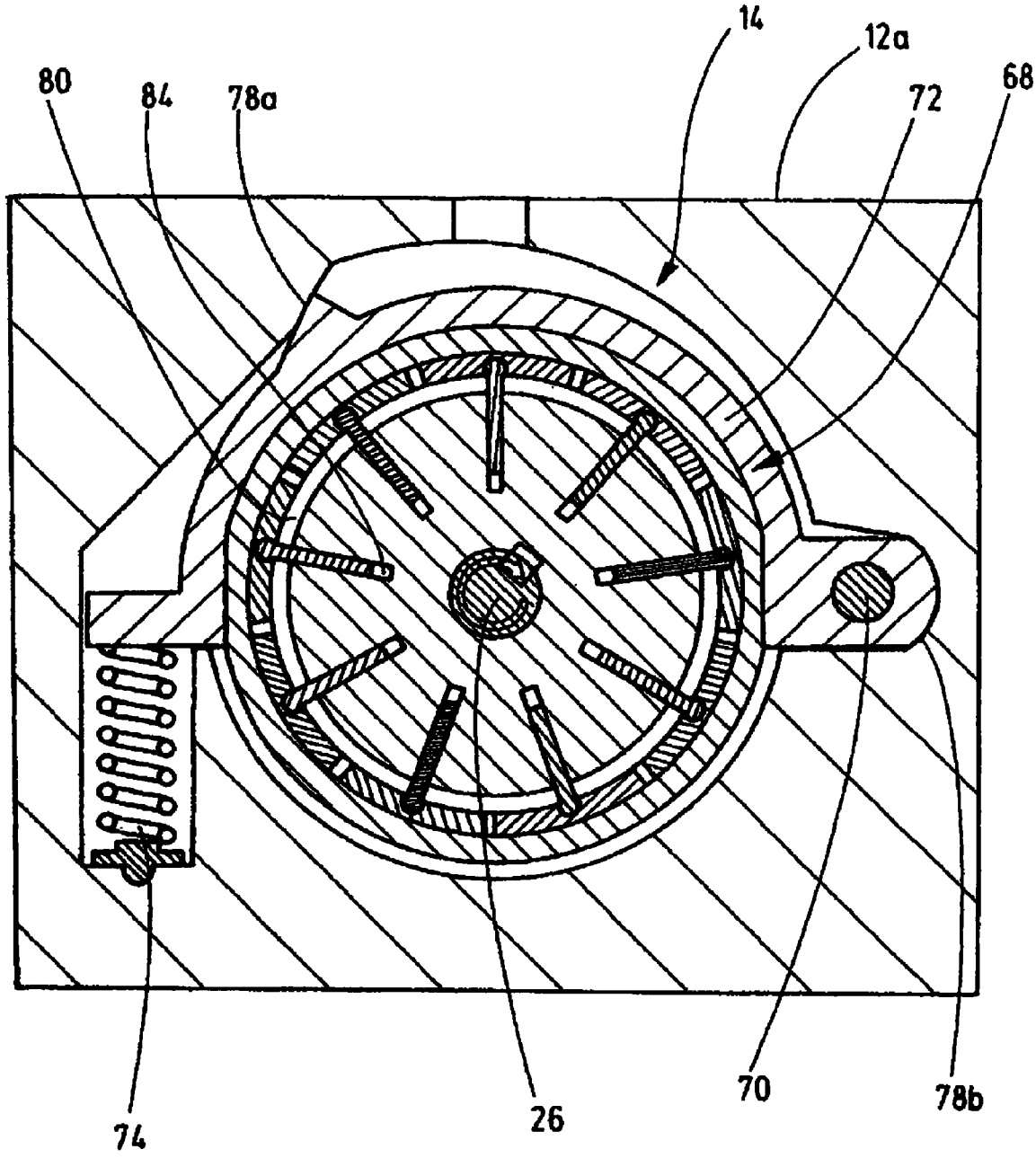
FIG. 9 shows a representation similar to FIG. 7 of the vane pump in a different operating state.

FIG. 9 shows the vane pump 10 in a state in which the bracket element 72 is displaced against the tension of the spring 74 in such a way that the center axis of the unit 68 and the swivel axis of the drive shaft 26 are concentric. It can clearly be seen that, in this case, the first delivery cells 80 and the second delivery cells 84 do not change volume even in response to rotation of the drive axis 26, so that the vane pump 10 does not deliver any fluid in this operating position.

I claim:

1. A vane machine comprising:

a housing;

an outer ring disposed within said housing;

at least one inner rotor;

at least one outer rotor having a plurality of shoes seating on an inner surface of said outer ring;

a plurality of vane elements extending substantially radially to define separate first delivery cells, each of said vane elements being held in said inner rotor for displacement in a radial direction at a radially inner end area of said vane elements and being held in a pivotable manner in one respective shoe of said outer rotor at a radially outer end area of said vane elements, wherein said radially inner end areas of said vane elements are substantially held in said inner rotor at fixed angles;

means defining a guide in which at least one lateral edge area of each said shoe is guided in a sliding fashion; and a bracket element disposed within said housing and mounted to pivot about a pivot axis with respect thereto, said bracket element bearing said outer ring, said bracket element and said housing defining a pressure region, wherein said bracket element is structured to pivot about said pivot axis when said pressure region is subjected to fluid pressure.

2. The vane machine of claim 1, wherein said radially external end area of said vane element cooperates in a pivoting manner with said respective shoe during operation of the vane machine, thereby positively driving said shoe in a circumferential direction.

3. The vane machine of claim 1, wherein said outer ring rotates with said bracket element when said pressure region is subjected to the fluid pressure.

4. The vane machine of claim 1, wherein said guide means is formed between said outer ring and a ring-shaped step of a lateral cover element.

5. The vane machine of claim 1, wherein a sliding bearing of said shoes works dryly.

6. The vane machine of claim 1, wherein said shoes extend sufficiently far in a circumferential direction that, in each area of the vane machine in which a volume of said first delivery cells is minimal, a gap between adjacent shoes is almost zero.

7. The vane machine of claim 1, wherein the machine defines at least one second delivery cell which is formed between said radially internal end area of said vane element and said inner rotor.

8. The vane machine of claim 7, wherein said first and second delivery cells are connected to each other via at least one delivery channel.

9. The vane machine of claim 8, wherein said delivery channel is a notch in a lateral cover element, in which said channel runs at an angle with respect to said radial direction which is larger than 0°.

10. The vane machine of claim 9, wherein said angle is larger than 45°.

11. The vane machine of claim 1, wherein at least one first suctioning cell and at least one second suctioning cell are connected to each other via at least one suction channel, said suction channel being a notch in a lateral cover element in which said suction channel runs at an angle with respect to said radial direction which is larger than 45°.

* * * * *